US009504305B2

(12) United States Patent
Jung et al.

(10) Patent No.: US 9,504,305 B2
(45) Date of Patent: Nov. 29, 2016

(54) TUBE-TYPE COSMETIC CONTAINER HAVING DOUBLE DISCHARGE MEANS

(71) Applicant: YONWOO CO., LTD., Incheon (KR)

(72) Inventors: Hyo-Sun Jung, Incheon (KR); You-Seob Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 14/424,136

(22) PCT Filed: Aug. 30, 2013

(86) PCT No.: PCT/KR2013/007822

§ 371 (c)(1),
(2) Date: Feb. 26, 2015

(87) PCT Pub. No.: WO2014/035184

PCT Pub. Date: Mar. 6, 2014

(65) Prior Publication Data

US 2015/0250292 A1 Sep. 10, 2015

(30) Foreign Application Priority Data

Aug. 30, 2012 (KR) ..... 10-2012-0095697

(51) Int. Cl.

| | |
|---|---|
| ***A45D 40/26*** | (2006.01) |
| ***A45D 40/28*** | (2006.01) |
| ***A45D 34/04*** | (2006.01) |
| *A45D 40/00* | (2006.01) |

(52) U.S. Cl.

CPC ..... *A45D 40/26* (2013.01); *A45D 34/04* (2013.01); *A45D 40/262* (2013.01); *A45D 40/28* (2013.01); *A45D 2040/0025* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,026,189 | A * | 6/1991 | Keil | B43K 17/00 401/198 |
| 7,290,955 | B2 * | 11/2007 | Patel | B43K 1/00 401/116 |
| 7,473,046 | B2 * | 1/2009 | Kraus | A46B 5/00 15/114 |

FOREIGN PATENT DOCUMENTS

| | | | |
|---|---|---|---|
| JP | 2011-516234 | A | 5/2011 |
| JP | 2011-518598 | A | 6/2011 |
| KR | 2011-0011979 | U | 12/2011 |
| KR | 2012-0019609 | A | 3/2012 |
| WO | WO-96-06017 | A1 | 2/1996 |

OTHER PUBLICATIONS

International Search Report issued in PCT/KR2013/007822 dated Oct. 15, 2013.

* cited by examiner

*Primary Examiner* — David Walczak
(74) *Attorney, Agent, or Firm* — Marshall, Gerstein & Borun LLP

(57) ABSTRACT

A tube-type cosmetic container has double discharge means, in which a lifting member coupled with a puff ascends or descends according to the rotation of a rotation body, wherein a nozzle is not exposed when the a lifting member ascends, and the nozzle is exposed when the lifting member descends, so that it is possible to easily apply the contents over a wide area or a localized area of a face by using the puff or the nozzle according to the selection of a user, thereby providing a user with convenience.

6 Claims, 4 Drawing Sheets

TUBE-TYPE COSMETIC CONTAINER HAVING DOUBLE DISCHARGE MEANS

CROSS-REFERENCE TO RELATED APPLICATION

This application is a U.S. National Stage application of International Patent Application No. PCT/KR2013/007822, filed Aug. 30, 2013, and claims the benefit of, and priority to, Korean Patent Application No. 10-2012-0095697, filed Aug. 30, 2012, and incorporated by reference herein in its entirety and for all purposes.

BACKGROUND

In the cosmetic containers, generally toner, lotion, and eye cream, etc. are contained. Cosmetic containers are particularly convenient for gel-type cosmetics such as lotion, eye cream, etc. and tube-type cosmetic containers are used widely due to low manufacturing cost.

Those existing cosmetic containers comprise discharge means like a brush which absorbs and discharges contents from the container to the outside, so that it is possible to apply gel-type cosmetics and rub cosmetics to skin, thus proceeding to make-up.

However, a traditional tube-type cosmetic container with a puff or a brush has a problem in that it is possible to easily apply cosmetics over a wide area, but when applying a localized area of a face, it is easily smeared to other areas and a user should find another way to apply cosmetics onto the localized area, which leads to inconvenience to the user.

SUMMARY

The present disclosure relates to a tube-type cosmetic container having double discharge means, in which a lifting member coupled with a puff ascends or descends according to the rotation of a rotation body, wherein a nozzle is not exposed when the a lifting member ascends, and the nozzle is exposed when the lifting member descends, so that it is possible to easily apply the contents over a wide area or a localized area of a face by using the puff or the nozzle according to the selection of a user, thereby providing a user with convenience.

The presently disclosed embodiments are devised to solve the said problems above, with the goal of providing a tube-type cosmetic container having double discharge means, wherein a lifting member coupled with a puff ascends or descends according to the rotation of a rotation body, a nozzle is not exposed when the lifting member ascends, and the nozzle is exposed when the lifting member descends so that it is possible to easily apply the contents over a wide area or a localized area of a face by using the puff or the nozzle according to the selection of a user, thereby providing convenience to the user.

To solve the above problems, a tube-type cosmetic container having double discharge means comprises: a tube body wherein contents are held and a discharging part is formed on the upper part; a body which is confined on the upper part of the container body; a nozzle member comprising a nozzle which is connected with the discharging part and is extended upwards on the center of the body; a rotation body which is combined on the upper part of the nozzle member so as to be able to rotate; a lifting member comprising a discharging member which ascends and descends according to the rotation of the rotation body, as either exposing or hiding the nozzle, wherein a discharging member absorbs contents that is discharged through the nozzle.

Furthermore, it is featured that the rotation body and the lifting member have an oval shape and is composed to be rotated along with the lifting member by the rotation of the rotation body.

Furthermore, it is featured that on both side surfaces of the nozzle is formed a pair of guide protrusions which ascend and descend the lifting member when the rotation body is rotated.

Furthermore, it is featured that on the center of the lifting member is formed a lift guiding part which encircles the nozzle with the shape of a cylinder, and comprises a spiral groove so that a pair of guide protrusions are inserted and moved respectively.

Furthermore, it is featured that on the lower part of the nozzle is formed a separation preventing protrusion which prevents the rotation body from being separated.

Furthermore, it is featured that on the inner lower part of the rotation body is provided a fixing plate which is located on the lower end of the separation preventing protrusion, and prevents the rotation body from being separated.

Furthermore, it is featured that a soft inclined plane is provided on the upper end of the separation preventing protrusion, so as to prevent interference with the fixing plate when the rotation body is combined.

As shown in the above, according to the present disclosure, a lifting member coupled with a puff ascends or descends according to the rotation of a rotation body, wherein a nozzle is not exposed when the a lifting member ascends, and the nozzle is exposed when the lifting member descends, so that it is possible to easily apply the contents over a wide area or a localized area of a face by using the puff or the nozzle according to the selection of a user, thereby providing a user with convenience.

DETAILED DESCRIPTION

Figure 1:
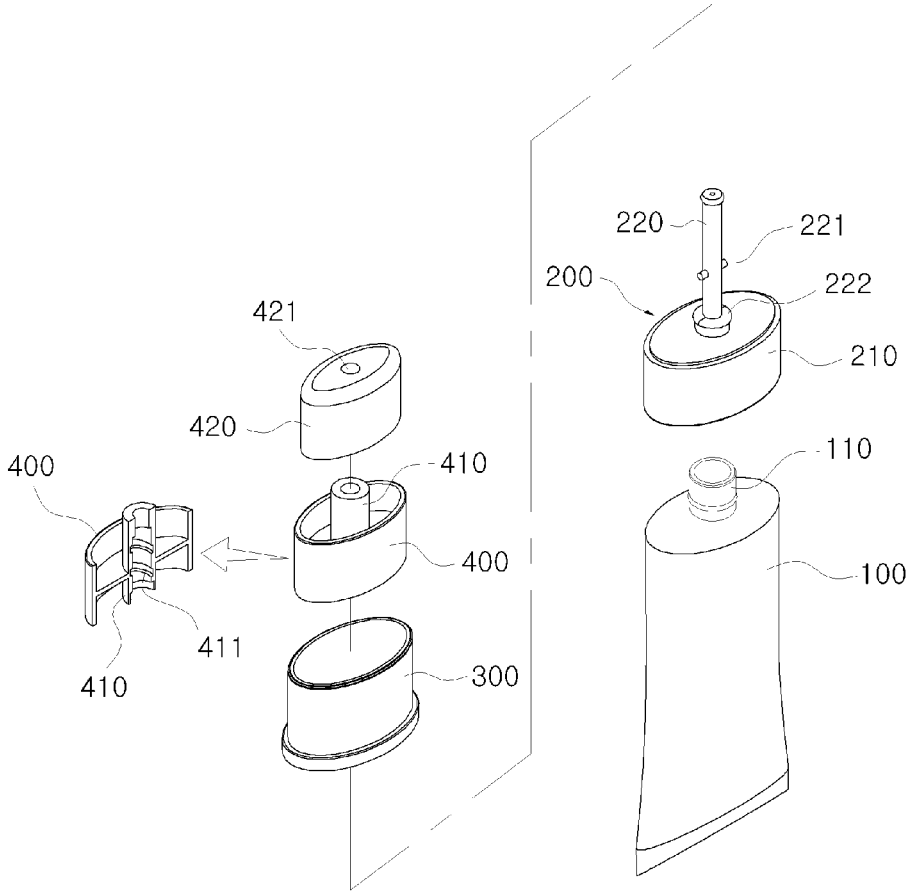
FIG. 1 is an exploded perspective view illustrating a configuration of a tube-type cosmetic container having double discharge means according to an exemplary embodiment of the present disclosure.

Hereinafter, exemplary embodiments of the present disclosure will be described in detail with reference to the accompanying drawings. The same reference numerals provided in the drawings indicate the same members.

Figure 2:
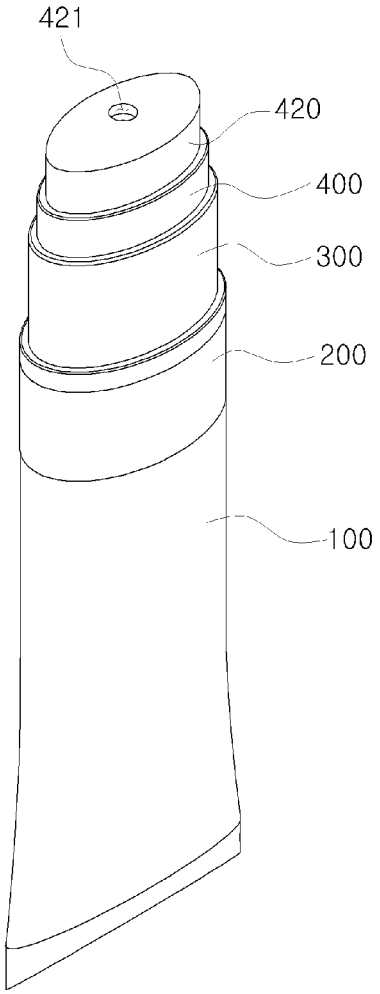
FIG. 2 is an assembled perspective view illustrating a configuration of a tube-type cosmetic container having double discharge means according to an exemplary embodiment of the present disclosure.
Figure 3:
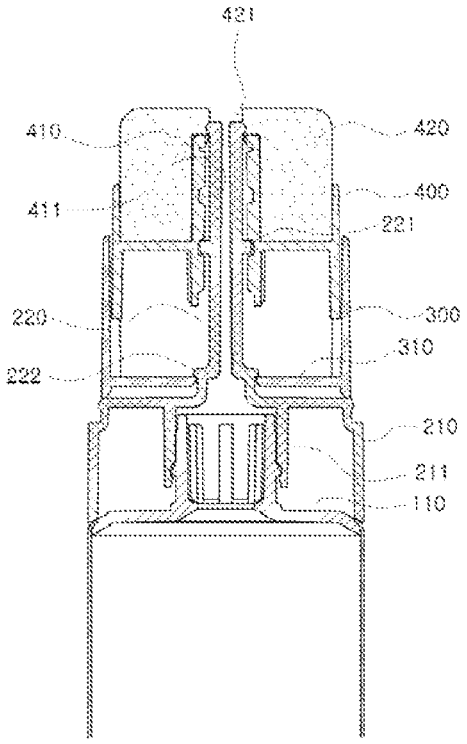
FIG. 3 is an assembled cross-sectional view illustrating a tube-type cosmetic container having double discharge means according to an exemplary embodiment of the present disclosure.

FIG. 1 is an exploded perspective view illustrating a configuration of a tube-type cosmetic container having double discharge means according to an exemplary embodiment. FIG. 2 is an assembled perspective view illustrating a configuration of a tube-type cosmetic container having double discharge means according to an exemplary embodiment. FIG. 3 is an assembled cross-sectional view illustrating a configuration of a tube-type cosmetic container having double discharge means according to an exemplary embodiment.

Referring to FIGS. 1 to 3, a tube-type cosmetic container having double discharge means according to an exemplary embodiment may include a container body 100, a nozzle member 200, a rotation body 300, and a lifting member 400.

The tube body 100 may contain contents such as cosmetics, wherein a discharging part 110 is formed on the upper part of the container body 100 to make it possible to discharge contained contents. The tube body 100 is preferred to be made of tube material so as to enable contents to be discharged by pressurizing the tube body by a user.

The nozzle member 200, comprising a body 210 and a nozzle 220, is combined to the upper part of the tube body 100 and discharges the contents to the outside.

The body 210 is combined on the upper part of the tube body 100, encircling the discharging part 110, wherein a combining part 211 is provided on the inner part of the body 210, so as to make the body's 210 combining with discharging part 110 possible. It is preferred that the combining part 211 is fixed to the discharging part 110, and thus prevents the rotation of the nozzle member 200.

The nozzle 220 is connected and extended upwards on the center of the body 210 and discharges to the outside the contents held in the tube body 100, wherein the nozzle 220 is connected with the discharging part 110 for contents to be discharged.

A pair of guide protrusions 221 are formed on both side surfaces of the nozzle 220 so as to ascend and descend lifting member 400 when a rotation body 300, which will be described later, rotates, wherein a pair of the guide protrusions 221 are inserted into spiral grooves 411 and guide to ascend or descend the lifting member 400 according to the rotation of the lifting member 400.

Meanwhile, on the lower part of the nozzle 220 is provided a separation preventing protrusion 222 that prevents the separation of the rotation body 300, wherein it is preferable that the upper end of the separation preventing protrusion 222 forms a gentle slope so that the upper end of the separation preventing protrusion 222 may not interfere with a fixing plate 310 but easily be provided when the rotation body is engaged.

The rotation body 300 is provided to the upper part of the nozzle member 200 to be able to be rotated, wherein the fixing plate 310 is equipped from the upper part of the separation preventing protrusion 222 to the downward direction with combined fit.

The fixing plate 310 is engaged with combined fit with the separation preventing protrusion 222 and supports the lower end of the separation preventing protrusion 222, thus preventing the rotation body 300 from being separated upwards and thereby the rotation body 300 from being separated from the nozzle member 200.

Meanwhile, the rotation body 300 has an oval shape and is made to rotate a lifting member 400 by a user which will be described later.

The lifting member 400 is composed to ascend and descend by the rotation of the rotation body 300, either hiding or exposing the nozzle 220, which has an oval shape that corresponds to the shape of the rotation body 300 in order to be rotated together when the rotation body 300 is rotating.

On the center of the lifting member is equipped a lift guiding part 410 which is cylinder-shaped and encircles the nozzle 220, wherein a spiral groove 411 is formed along the inner circumferential surface on the lift guiding part 410 so that the guide protrusion 221 may be inserted, and thus the lifting member 400 ascends or descends according to the rotation of one side or another.

It is preferable that the spiral groove 411 is formed in two rows of spirals so that a pair of parallel guide protrusions 221 may be inserted.

Meanwhile, on the lifting member 400 is formed a discharging member 420 to allow contents to be absorbed and discharged to the outside through the nozzle 220, wherein the discharging member 420 comprises a puff or a brush that can absorb and apply contents. An outlet hole 421 is formed on the center of the upper end of the discharging member 420 to allow the nozzle 220 to enter.

When the lifting member 400 ascends by one side rotation of the rotation body 300, the lifting member 400 makes the nozzle 220 not exposed by the discharging member 420, and the contents discharged from the nozzle 220 can be absorbed through the discharging member 420 for being used, whereas when the rotation body 300 descends by the other side rotation, the contents can be used by exposing the nozzle 220 to the outside.

Therefore, depending on the area that a user intends to apply make-up, a wide area can be applied with the discharging member 420 while a localized area can be applied with a nozzle 220.

Figure 4:
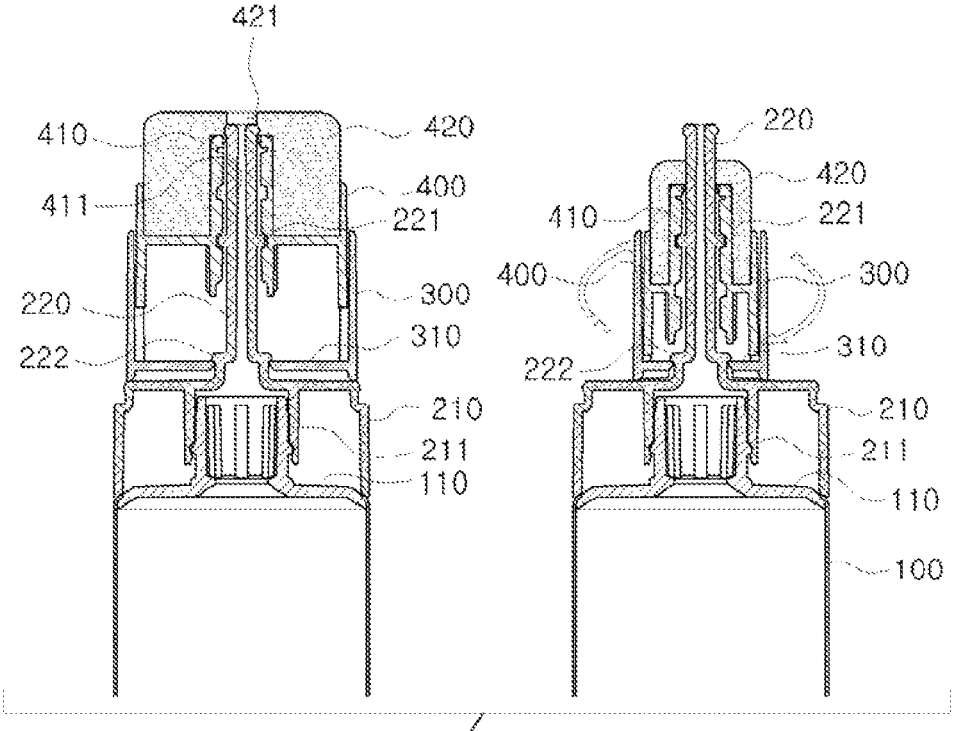
FIGS. 4 and 5 are views illustrating an operational state of a tube-type cosmetic container having double discharge means according to an exemplary embodiment of the present disclosure.
Figure 5:
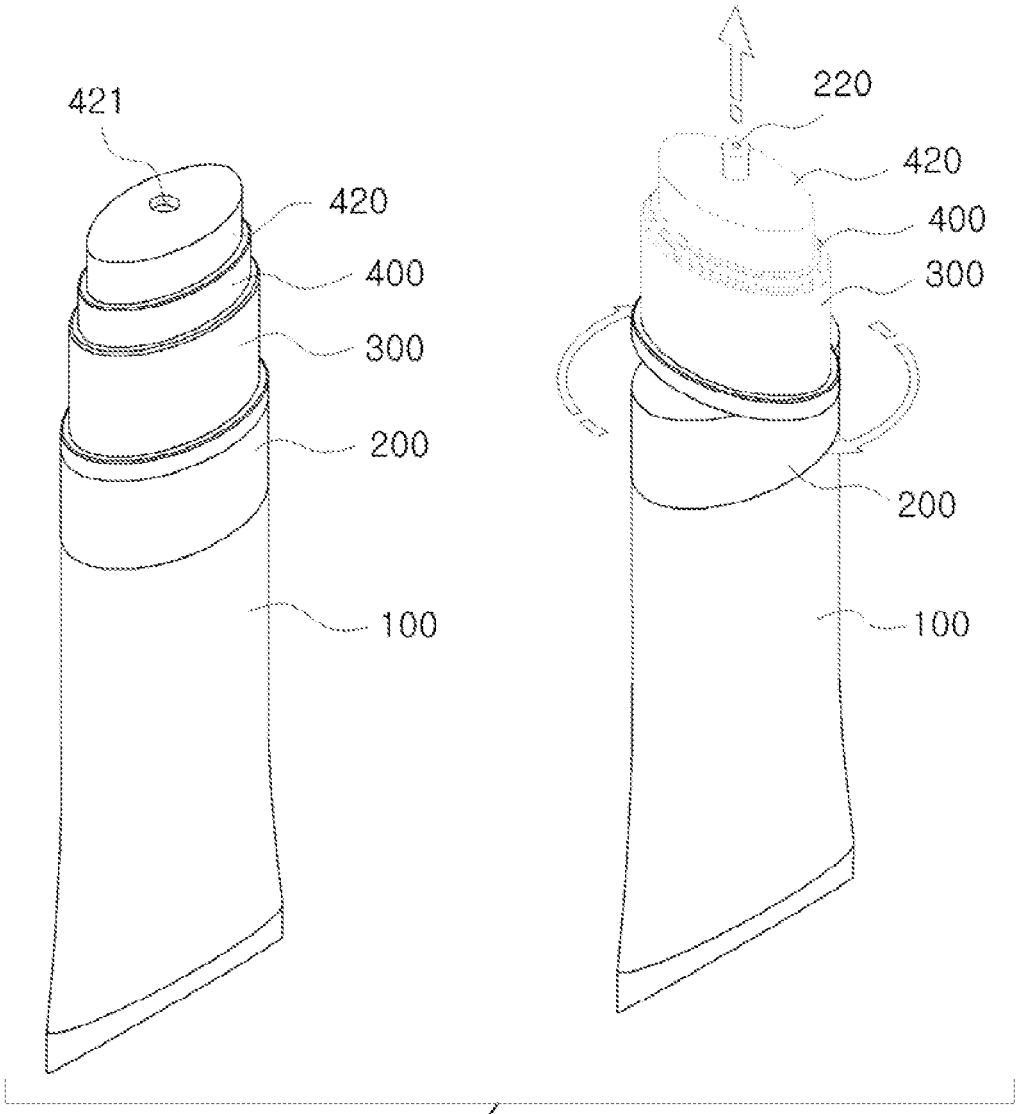

Hereinafter, an operational state of a tube-type cosmetic container having double discharge means according to an exemplary embodiment will be described with reference to FIGS. 4 and 5. FIGS. 4 and 5 are views illustrating an operational state of a tube-type cosmetic container having double discharge means according to an exemplary embodiment.

Referring to FIGS. 4 and 5, in a tube-type cosmetic container having double discharge means according to an exemplary embodiment, when the lifting member 400 ascends at first, the nozzle 220 is in the position of not being exposed to the outside by the discharging part 420; at this moment, if the tube body 100 is pressurized, the contents discharged through the nozzle 220 is absorbed into the discharging member 420, and applying contents through the discharging member 420 can be possible.

Next, while the lifting member 400 is ascending, if the rotation body 300 is rotated into one side direction, the lifting member 400 can be rotated with the rotation body 300, when the guide protrusion 221 moves along the spiral groove 411 formed on the lifting member 400, and thus applying contents through the nozzle 220 can be possible.

As shown above, when the lifting member 400 descends, the discharging member 420 coupled with the lifting member 400 descends together, exposing the nozzle 220 to the outside, and thereby applying contents through the nozzle 220 is possible.

As described above, when the lifting member 400 descends, the discharging member 420 combined with the lifting member 400 also descends, and then the nozzle 220 is exposed to the outside, thus making usage of the optimal embodiments have been disclosed in the drawings and the specification. Although specific terms have been used herein, these are only intended to assist in understanding the present disclosure and are not intended to limit the meanings of the terms or to restrict the scope of the accompanying claims. Therefore, those skilled in the art will appreciate that various modifications and other equivalent embodiments are possible from the above embodiments, and the scope of the present invention should be defined by the technical spirit of the accompanying claims.

What is claimed is:

1. A tube-type cosmetic container having two discharge methods, comprising:

a tube body containing contents and having a discharging part on an upper part;

a nozzle member comprising a body coupled on an upper portion of the tube body and a nozzle connected with the discharging part and extended upwards on the center of the body;

a rotation body mounted on an upper portion of the nozzle to be able to be rotated; and a lifting member which is ascended/descended by the rotation of the rotation body and then hides or exposes the nozzle, forming a discharging member 420 which absorbs contents discharged through the nozzle, wherein a pair of guide protrusions is provided on side surfaces of the nozzle, and ascends and descends the lifting member when the rotation body rotates.

2. The tube-type cosmetic container of claim 1, wherein the rotation body and the lifting member have an oval shape and are composed to rotate together by the rotation of the rotation body.

3. The tube-type cosmetic container of claim 1, comprising a lift guiding part at a center of the lifting member, wherein the lift guiding part has a cylindrical shape encircling the nozzle and comprises a spiral groove formed along an inner circumferential surface thereof such that the pair of guide protrusions are inserted respectively and moved.

4. The tube-type cosmetic container of claim 1, comprising a separation preventing protrusion, which prevents the rotation body from being separated.

5. The tube-type cosmetic container of claim 4, wherein a fixing plate is provided on a lower end of the separation preventing protrusion in an inner lower part of the rotation body and prevents the separation of the rotation body.

6. The tube-type cosmetic container of claim 5, wherein a gentle slope is provided on an upper end of the separation preventing protrusion to block interference with the fixing plate when the upper end of the separation preventing protrusion interacts with the rotation body.

* * * * *